US008893316B1

(12) United States Patent
Smith

(10) Patent No.: US 8,893,316 B1
(45) Date of Patent: Nov. 25, 2014

(54) SOLID FRAME FOLDABLE TOILET ADAPTER

(71) Applicant: Roy Smith, Mansfield, TX (US)

(72) Inventor: Roy Smith, Mansfield, TX (US)

( * ) Notice: Subject to any disclaimer, the term of this patent is extended or adjusted under 35 U.S.C. 154(b) by 0 days.

(21) Appl. No.: 13/947,982

(22) Filed: Jul. 22, 2013

(51) Int. Cl.
*E03D 11/00* (2006.01)
*A47K 13/00* (2006.01)
*A47K 17/02* (2006.01)

(52) U.S. Cl.
CPC ..... *A47K 13/005* (2013.01); *A47K 17/026* (2013.01)
USPC ..... 4/254; 4/239; 4/667

(58) Field of Classification Search
CPC .... A47K 13/005; A47K 13/02; A47K 17/026
USPC ..... 4/236, 237, 239, 240, 254, 449, 460, 4/465, 578.1, 604, 667; 297/DIG. 10
See application file for complete search history.

(56) References Cited

U.S. PATENT DOCUMENTS

| | | | | |
|---|---|---|---|---|
| 6,233,753 | B1 * | 5/2001 | Battiston | 4/254 |
| 6,675,401 | B2 * | 1/2004 | Peterson et al. | 4/604 |
| 8,051,504 | B1 * | 11/2011 | Folds | 4/239 |
| 2011/0291387 | A1 * | 12/2011 | Chang Liao | 280/647 |

* cited by examiner

*Primary Examiner* — Tuan N Nguyen

(57) ABSTRACT

A toilet adapter easing access for the disabled comprised of a one-piece welded metal frame with a front side, a back side, a first side, and a second side, with each side welded at a 90° angle. The frame also includes a pair of supporting members welded at a 90° angle between the front side and the back side. A toilet seat assembly attaches to the metal frame, and a first leg assembly and a second leg assembly each attach to the frame using a piano hinge that rotates the leg assembly 90° inward from an extended position. The second leg assembly attaches to an extension so that it rotates to fit flush against the first leg assembly when rotated inward 90°.

20 Claims, 1 Drawing Sheet

SOLID FRAME FOLDABLE TOILET ADAPTER

BACKGROUND

The present application relates to a solid foldable frame toilet adapter to aid persons with disabilities or other movement issues, and more particularly to a toilet adapter positioned over a commode to aid getting on or off a toilet.

Similar toilet adapters are typically constructed from component parts assembled using fasteners. The construction of the frame of these toilet adapters typically comprises multiple components assembled using various types of fasteners. They are also typically constructed from light sheet metal aluminum tubing of a very light gauge, with a thickness of a millimeter or two.

Virtually all currently available toilet adapters share this design weakness. The toilet adapter herein uses a thicker gauge aluminum with a rectangular cross section and welded construction. The one piece, solid frame design is more sturdy and easier to fold for compact storage.

The toilet adapter described herein provides aid to disabled persons to use the toilet without any other aids or caretaker assistance. It also folds for easy and convenient storage when not in use.

The inventions will allow many of disabled Americans to use a toilet by assisting with getting up and down without the aid of a family member or caregiver. This may save government and insurance companies considerable expenditures by providing the disabled the freedom and ability to maintain their independence and remain in their homes.

The inventor is disabled and designed the described solid frame toilet adapter to address the needs of others similarly situated. Prior to using this designed toilet adapter, he was unable to lift himself from the toilet seat. The solid frame toilet adapter enables ease of access without undue bulk and the ability to easily fold for storage or to travel with.

SUMMARY

The present application discloses a solid frame, foldable toilet adapter with an adjustable height.

In some embodiments, the inventions include a seamless, rectangular metal frame with foldable support legs that a toilet seat attaches.

The disclosed innovations, in various embodiments, provide one or more of at least the following advantages. However, not all of these advantages result from every one of the innovations disclosed, and this list of advantages does not limit the various claimed inventions.

Simpler frame construction.

Fewer fasteners.

No subcomponents assembled with fasteners.

Ruggedness.

Ease of storage.

BRIEF DESCRIPTION OF THE DRAWINGS

The disclosed inventions will be described with reference to the accompanying drawings, which show important sample embodiments of the inventions and which are incorporated in the specification hereof by reference, wherein.

DETAILED DESCRIPTION OF SAMPLE EMBODIMENTS

The numerous innovative teachings of the present application will be described with particular reference to presently preferred embodiments (by way of example, and not of limitation). The present application describes several inventions, and none of the statements below should be taken as limiting the claims generally.

Figure 1:
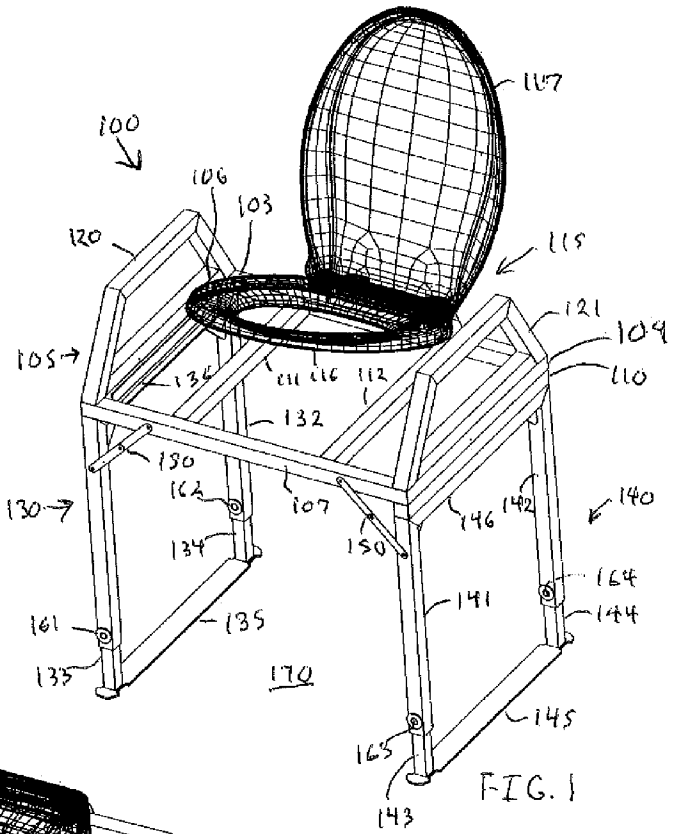
FIG. 1 depicts a perspective view of an exemplary toilet adapter with the toilet seat partially raised to show the overall construction of the toilet adapter.

FIG. 1 depicts a perspective view of an exemplary toilet adapter with the toilet seat partially raised to show the overall construction of the toilet adapter. The exemplary solid frame, foldable toilet adapter with an adjustable height depicted in FIG. 1 uses a one-piece solid frame made from rectangular cross-sectioned shaped hollow metal members welded together. The toilet adapter 100 comprises four main components, namely a frame, toilet seat assembly, hand grips, and leg assemblies.

As depicted, the frame 105 comprises a rectangular structure with a right side metal member 106 welded at a 90° angle to a pair of members forming a front side metal member 107 and a back side metal member 108. The opposite ends of front metal member 107 and back metal member 108 are similarly welded at a 90° angle to a left side metal member 109. Additionally, frame 105 also comprises a second left side member 110 welded below left side member 108 acting as an extension to extend an attached leg assembly so it fits flush against the other attached leg assembly when folded. Alternatively, left side member 109 can be formed from a section of metal twice as wide, vertically, as the right side metal member 108 to offset an attached leg assembly and extend the attached leg assembly so it fits flush.

The frame 105 also comprises two supporting metal members 111 and 112 welded at 90° angles between front metal member 107 and back metal member 108. The welded position of right side supporting metal member 111 and left side supporting member 112 also provides a reinforcement to support the weight of an individual using the toilet adapter 100.

As depicted, a toilet seat assembly 115 attaches to back metal member 108. The toilet seat assembly 115 comprises an open roughly circular/semi-circular/roughly oblong seat 116 and a matching solid cover 117 attached together and to the frame 105 by a hinge assembly so the seat 116 and cover 117 independently rotate between a down and up position.

A pair of folding hand grips 120 and 121 attach to the frame 105 using piano hinges running the length of the hand grips 120 and 121 and match the width of frame 105. Each hand hold 120 and 121 comprise a cross-sectioned piece of metal of the same thickness as the frame 105. Right hand hold 120 comprises a one-piece component formed into a trapezoid, though other shapes are possible. Left hand hold 121 comprises a one-piece component formed into a trapezoid, though other shapes are possible.

As depicted, two leg assemblies 130 and 140 attach to the frame 105 using piano hinges to permit each of leg assemblies 130 and 140 to rotate inward 90°. A front upper leg 131 and back upper leg 132 are welded to a top metal bar 136. Top metal bar 136 attaches to right side metal member 106 using a piano hinge running the length of right side metal member 106 and top metal bar 136 so as to allow leg assembly 130 to rotate 90°. A front upper leg 141 and back upper leg 142 are welded to a top metal bar 146. Top metal bar 146 attaches to second left side member 110 using a piano hinge running the length of second left side member 110 and top metal bar 136 so as to allow leg assembly 140 to rotate 90°. Two locking toggles 150 connect the front side metal member 106 and 107 with leg assemblies 130 and 140, respectively, to securely lock leg assemblies 130 and 140 in place when rotated outward in an open position to extend vertically downward to a floor 170. Although locking toggles 150 are only shown attached to the front of toilet adapter 100, it is readily apparent that locking toggles 150 can be positioned in back of toilet adapter 100 as well.

As depicted, leg assembly 130 includes the upper front leg 131 and an upper back leg 132. The upper front leg 131 and upper back leg 132 are welded to the upper leg metal bar 136, which attaches to right side metal member 106 using a piano hinge (not shown). Lower front leg 133 telescopes down from upper front leg 131, and similarly lower back leg 134 telescopes down from upper back leg 132. "Telescopes" as used herein, means a smaller size lower leg (133 and 134 in this case) fits within the hollow core structure of a larger size upper leg (131 and 132 in this case) so as to slide up and down therein. Locking pin 161 extends outward from lower front leg 133 to project through a corresponding hole in upper front leg 131 to lock the lower front leg 133 and front leg 131 in position by blocking any sliding motion. Locking pin 161 can comprise a spring-loaded retention pin that extends outward from lower front leg 133 to project through a corresponding hole in front leg 131, or a detent pin passing through holes in both the lower front leg 133 and front leg 131 to lock the lower front leg 133 and front leg 131 in position by blocking any sliding motion when inserted in place.

Similarly, locking pin 162 extends outward from lower back 134 to project through a corresponding hole in upper back leg 132 to lock the lower back leg 134 and back leg 132 in position by blocking any sliding motion. Locking pin 163 can comprise a spring-loaded retention pin that extends outward from lower back leg 134 to project through a corresponding hole in back leg 132 or a detent pin passing through holes in both the lower back leg 134 and back leg 132 to lock the lower back leg 134 and back leg 132 in position by blocking any sliding motion when inserted in place.

Attached to the lower end of and between lower front leg 133 and lower back leg 134 is a base 135. Base 135 comprises a long, relatively narrow strip of metal, positioned so as run the length between the lower front leg 131 and rear lower leg 134 to form base 135 contacting a floor 170. Base 135 further comprises a gripping, non-slip material, such as rubber or a similar soft non-slippery substance, applied to base 135 so as to be in contact with the floor 170.

As depicted, leg assembly 140 includes an upper front leg 141 and an upper back leg 142. The upper front leg 141 and upper back leg 142 are welded to the upper leg metal bar 146, which attaches to right side metal member 146 using a piano hinge (not shown). Lower front leg 143 telescopes down from upper front leg 141, and similarly lower back leg 144 telescopes down from upper back leg 142. Locking pin 163 passes through lower front leg 143 and front leg 141 lock the lower front leg 143 and front leg 141 in position by blocking any sliding motion. Pin 163 can comprise a spring-loaded retention pin that extends outward from lower front leg 143 to project through a corresponding hole in front leg 141 or a detent pin passing through holes in both the lower front leg 143 and front leg 141 to lock the lower front leg 143 and front leg 141 in position by blocking any sliding motion when inserted in place.

Similarly, locking pin 164 passes through lower front leg 144 and front leg 142 lock the lower front leg 144 and front leg 142 in position by blocking any sliding motion. Locking pin 164 can comprise a spring-loaded retention pin that extends outward from lower front leg 144 to project through a corresponding hole in front leg 142 or a detent pin passing through holes in both the lower front leg 144 and front leg 142 to lock the lower front leg 144 and front leg 142 in position by blocking any sliding motion when inserted in place.

As can readily be appreciated, multiple holes can be installed in the legs to adjust the height of the adapter over the toilet. In one exemplary embodiment, the height can be adjusted to between 20" and 28".

Attached to the lower end of and between lower front leg 143 and lower back leg 144 is a base 145. Base 145 comprises a long, relatively narrow strip of metal, positioned so as run the length between the lower front leg 143 and rear lower leg 144 to form base 145 contacting the floor 170. Base 145 further comprises a gripping, non-slip material, such as rubber or a similar soft non-slip substance, applied to base 145 so as to be in contact with the floor 170.

All five metal members 106, 107, 108, 109, and 110 comprise rectangular sections of metal, preferably aluminum and preferably about 2.5 mm thick, ranging from about 1.5 mm to 4 mm in an exemplary embodiment, and about 5 mm to 13 mm in cross section. Alternatively, these can compose metal of about ⅛" thickness to form into metal structure of about 0.25"×0.25". Alternatively, rather than a square cross section, the metal members can be formed from sections of metal tubing about 1/16" to ⅛" thickness and from about ½" to 1" in diameter. In one exemplary embodiment, the frame 105 measures about 26" in length and 15" in depth. The two supporting metal members 111 and 112 comprise two reinforcing crossbars centered and positioned about 11¾" apart.

In one exemplary embodiment, the hand grips 120 and 121 measure about 4½" high and 7" wide at the top with a base length of about 18", and attach using piano hinges flush with front metal member 107. The toilet seat assembly 115 in an exemplary embodiment bolts to an approximately 9" bar of metal (not shown) welded behind and in the center of back metal member 108 so as to extend the total depth of the toilet adapter beyond the width of frame 105. The leg assemblies in an exemplary embodiment 130 and 140 extend down from the frame 105 about 18" when extended to attach to the lower legs 133, 134, 143, and 144. These legs can be either constructed with a rectangular cross section or from tubing, to telescope and lock in place using hole positioned at 2" intervals, so as to adjust the toilet adapter 100 height from the floor to between 20" and 30". In one exemplary embodiment, upper leg metal top bar 136 and upper leg metal top bar 146 measure approximately ¼"×½", with upper metal bar 136 and upper metal bar 146 measuring about 14" long.

In one exemplary embodiment, the base 135 and base 145 measure approximately ¼" thick, 3" wide, and 19" long, welded approximately 3" from the front and 1" from the back to the leg assemblies.

Furthermore, in an exemplary embodiment, the toilet adapter 100 can include a splashguard made from thin plastic or sheet metal with a flange attachable to right side supporting metal member 111 and left side supporting member 112 below the seat 116 and cover 117, and approximately 6" to 10" in height.

In one exemplary embodiment, the total weight of the assembled toilet adapter 100 is about ten pounds and includes both aluminum and steel structural components.

Figure 2:
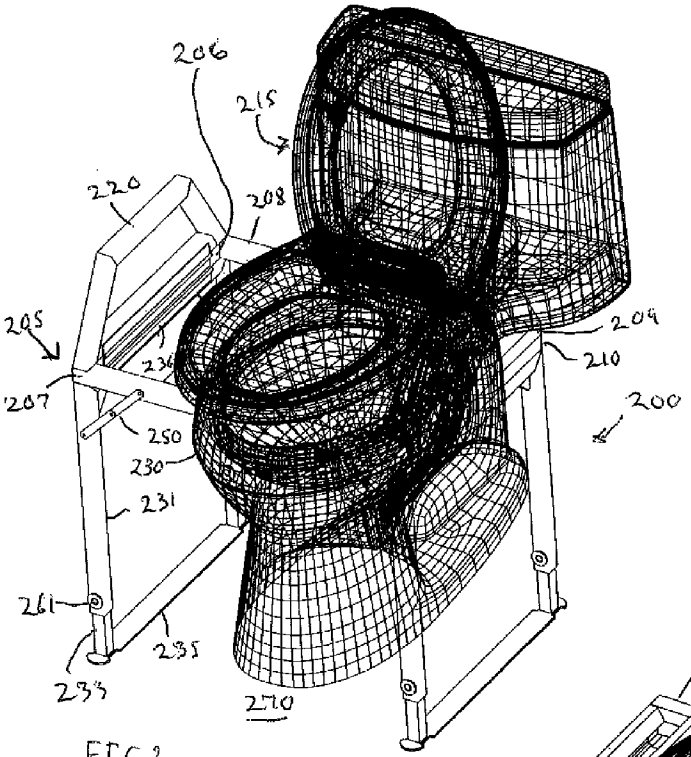
FIG. 2 depicts a perspective view of the exemplary toilet adapter of FIG. 1 fitted over a conventional toilet.

FIG. 2 depicts a perspective view of an exemplary toilet adapter 200 as depicted in FIG. 1 fitted over a conventional toilet 201. The position of the toilet adapter 200 superimposes the toilet seat assembly 215 directly over a toilet bowl 280 of a conventional toilet 201.

As depicted, the frame 205 comprises a rectangular welded structure with a right side metal member 206 welded at a 90° angle to a pair of members forming a front side metal member 207 and a back side metal member 208. The opposite ends of front metal member 207 and back metal member 208 are similarly welded at a 90° angle to a left side metal member 209. Additionally, frame 205 also comprises a second left side member 210 welded below left side member 208. Alternatively, left side member can be formed from a section of metal twice as wide, vertically, as the right side metal member 206. All five metal members 206, 207, 208, 209, and 210 comprise rectangular sections of metal, preferably aluminum and preferably about 2.5 mm thick, ranging from about 1.5 mm to 4 mm in an exemplary embodiment, and about or 25 mm square in cross section. Alternatively, these can compose metal of about ⅛" thickness to formed into metal structure of about 0.75"×0.75". Alternatively, rather than a square cross section, the metal members can be formed from sections of tubing about ⅛" thickness.

As depicted, a toilet seat assembly 215 attaches to back metal member 208. Folding hand hold 220 attaches to the right side metal member 206 using a piano hinge running the length of the hand grips 220 and right side metal member 206. Hand hold 220 comprises a cross-sectioned piece of metal of the same thickness as the right side metal member 206. Right hand hold 220 comprises a one-piece component formed into a trapezoid, though other shapes are possible. A corresponding left hand hold also attaches to left side metal member 209 in a similar manner.

As depicted, upper right leg 231 attaches to top metal member 236 using a piano hinge to permit upper right leg 231 to rotate inward 90°. Locking toggle 251 connects the front side metal member 207 and the upper right leg 231 to securely lock upper right leg 231 in place when rotated outward in an open position to extend vertically downward to a floor 270.

As depicted, a lower front leg 233 extends downward from upper front leg 231 to telescope downward to an attached base 235. Locking pin 261 extends outward from lower front leg 233 to project through a corresponding hole in upper front leg 231 to lock the lower front leg 233 and upper front leg 231 in position by blocking any sliding motion. Attached to lower front leg 233 is a base 235. Base 235 comprises a long, relatively narrow strip of metal, positioned so as the length of the base 235 contacts floor 270, and further comprises a gripping, slip-proof material, such as rubber or a similar soft non-slippery substance, applied to base 235 so as to contact the floor 270.

Figure 3:
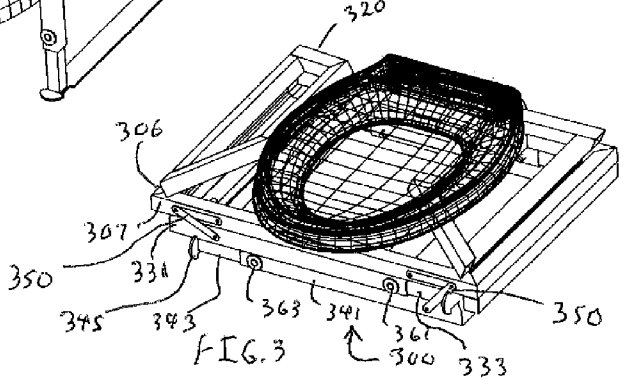
FIG. 3 depicts a perspective view of the exemplary toilet adapter of FIG. 1 folded for storage.

FIG. 3 depicts a perspective view of an exemplary toilet adapter 300 as depicted in FIG. 1 folded for storage. As depicted, a right side metal member 306 and left side metal member 309 welded at a 90° angle to a front side metal member 307 and a back side metal member 308 forms a frame. Additionally, a second left side member 310 welded below left side member 308 also comprises a part of the frame. All five welded metal members 306, 307, 308, 309, and 310 comprise rectangular sections of metal, preferably aluminum and preferably about 2.5 mm thick, ranging from about 1.5 mm to 4 mm in an exemplary embodiment, and about a ½ inch or 13 mm square in cross section.

As depicted, an upper front leg 331 welded to a longitudinal section of metal connects to right side metal member 306 by a piano hinge so as to fold inward 90°. A lower front leg 333 telescopes from upper front leg 331. Upper front leg 331 also comprises a locking pin 361 extending from a corresponding hole in lower front leg 333 to lock the upper front leg 331 and lower front leg 333 in place to prevent sliding movement. A locking toggle 350 locks the upper front leg 331 in place when in an open or extended position.

As depicted, an upper front leg 341 welded to a longitudinal section of metal connects to left side metal member 310 by a piano hinge so as to fold inward 90°. A lower front leg 343 telescopes from upper front leg 341. Upper front leg 341 also comprises a locking pin 363 extending from a corresponding hole in lower front leg 343 to lock the upper front leg 341 and lower front leg 343 in place to prevent sliding movement. A locking toggle 350 locks the upper front leg 341 in place when in an open or extended position.

As shown, to store, upper front leg 331 on the right first rotates upward 90° to fit flush against metal member 307 (with the corresponding back leg components folding up similarly). Upper front leg 341 on the left side can then rotate 90° to fit flush against lower front leg 333 and upper front leg 331 (with the corresponding back leg components folding up similarly). The hand grips 120 and 121 as shown in FIG. 1 can then rotate through about 60° to rest against the toilet cover 117 in a down configuration.

The foregoing has described methods and systems for a toilet adapter that are given for illustration and not for limitation and uses. Thus the inventions are limited only by the appended claims. Although the inventions have been described in accordance with the embodiments shown, one of ordinary skill in the art will readily recognize that there could be variations to the embodiments and those variations would be within the spirit and scope of the present inventions. Accordingly, many modifications may be made by one of ordinary skill in the art without departing from the spirit and scope of the appended claims.

According to various embodiments, there is provided: A toilet adapter, comprising a one-piece welded metal frame comprising a front side, a back side, a first side, and a second side, with each side welded at a 90° angle; a pair of supporting members welded at a 90° angle between the front side and the back side; a toilet seat assembly attached to the metal frame; and a first leg assembly and a second leg assembly, each attached to the frame using a piano hinge that rotates the leg assembly 90° inward from an extended position; wherein the second leg assembly attaches to an extension so second leg assembly rotates to fit flush against the first leg assembly when rotated inward 90°.

According to various embodiments, there is provided: A toilet adapter fitting over a conventional household toilet, comprising: a one-piece welded metal frame comprising a front side, a back side, a first side, and a second side, with each side welded at a 90° angle to an adjacent side; a first handgrip and a second handgrip attached to the frame; a toilet seat assembly attached to the metal frame; a first height adjustable leg assembly attached to the frame using a piano hinge that rotates the first height adjustable leg assembly 90° inward from an extended position to fit flush against the frame; a second height adjustable leg assembly attached to the frame using a piano hinge that rotates the second height adjustable leg assembly 90° inward from an extended position, wherein the second height adjustable leg assembly extends further down from the frame by attaching to an extension so the second height adjustable leg assembly rotates to fit flush against the first height adjustable leg assembly when rotated inward 90°.

A method for constructing a toilet adapter, comprising the steps of: welding a metal frame together, with a front side and a back sided welded at a 90° angle to a first side and a second side so as to form a one-piece rectangular frame; attaching a first height adjustable leg assembly to the frame using a piano hinge so that the first height adjustable leg assembly rotates 90° inward from an extended position to fit flush against the frame; attaching a second height adjustable leg assembly to the frame using a piano hinge so that the second height adjustable leg assembly rotates 90° inward from an extended position, wherein the second height adjustable leg assembly extends further down by way of an extension so the second height adjustable leg assembly rotates to fit flush against the first height adjustable leg assembly when rotated inward 90° over the retracted first height adjustable leg assembly; attaching a right hand grip to the frame using a piano hinge; attaching a left hand grip to the frame using a piano hinge; and attaching a toilet seat assembly to the metal frame.

MODIFICATIONS AND VARIATIONS

As will be recognized by those skilled in the art, the innovative concepts described in the present application can be modified and varied over a tremendous range of applications, and accordingly the scope of patented subject matter is not limited by any of the specific exemplary teachings given. It is intended to embrace all such alternatives, modifications and variations that fall within the spirit and broad scope of the appended claims.

The sizes provided are examples only. The toilet adapter described herein can accommodate obese or disable individuals and provides flexibility to adjust and adapt the disclosed embodiments to accommodate a variety of individual needs.

In some contemplated embodiments, the leg assembly may include further refinement to the attachment with the frame. In addition to the piano hinge, one or more magnets may be interposed between the frame and the leg assemblies to further stabilize the legs in the closed position. One or more additional locking toggles may also be added, such as one immediately behind locking toggle 150 connecting the rear of metal member 107 to the rear of front upper leg 131, or a different type of locking device may be used.

None of the description in the present application should be read as implying that any particular element, step, or function is an essential element which must be included in the claim scope: THE SCOPE OF PATENTED SUBJECT MATTER IS DEFINED ONLY BY THE ALLOWED CLAIMS. Moreover, none of these claims are intended to invoke paragraph six of 35 USC section 112 unless the exact words "means for" are followed by a participle.

The claims as filed are intended to be as comprehensive as possible, and NO subject matter is intentionally relinquished, dedicated, or abandoned.

What is claimed is:

1. A toilet adapter, comprising:

a one-piece welded metal frame comprising a front side, a back side, a first side, and a second side, with each side welded at a 90° angle;

a pair of supporting members welded at a 90° angle between the front side and the back side;

a toilet seat assembly attached to the metal frame; and a first leg assembly and a second leg assembly, each attached to the frame using a piano hinge that rotates the leg assembly 90° inward from an extended position;

wherein the second leg assembly attaches to an extension so second leg assembly rotates to fit flush against the first leg assembly when rotated inward 90°.

2. The toilet adapter of claim 1, wherein each leg assembly comprises a top metal bar having two ends and a leg welded to each of the two ends.

3. The toilet adapter of claim 2, wherein each leg welded to each of the two ends further comprises:

an upper leg welded to the top metal bar and a lower leg telescoping down from the upper leg; and the lower leg further comprises a locking pin engaging a corresponding hole in the upper leg to lock the upper leg and lower leg in position; and a base attached to the lower leg to contact a floor.

4. The toilet adapter of claim 1, further comprising:

a locking toggle disposed between the frame and the first leg assembly to lock the first leg assembly in place when in the extended position.

5. The toilet adapter of claim 1, wherein the extension comprises a third side member welded below the second side member.

6. The toilet adapter of claim 1, wherein the extension comprises the second side member about twice as wide vertically compared to the first side member.

7. The toilet adapter of claim 1, wherein the frame further comprises a bar of metal welded behind and parallel with the back member and the toilet seat assembly bolts to said bar.

8. The toilet adapter of claim 1, wherein the toilet assembly comprises a toilet seat and a toilet cover attached to the frame so as to both independently rotate between a down and up position.

9. The toilet adapter of claim 1, further comprising:

a first handgrip attached to the frame using a piano hinge; and a second handgrip attached to the frame using a piano hinge.

10. A toilet adapter fitting over a conventional household toilet, comprising:

a one-piece welded metal frame comprising a front side, a back side, a first side, and a second side, with each side welded at a 90° angle to an adjacent side;

a first handgrip and a second handgrip attached to the frame;

a toilet seat assembly attached to the metal frame;

a first height adjustable leg assembly attached to the frame using a piano hinge that rotates the first height adjustable leg assembly 90° inward from an extended position to fit flush against the frame;

a second height adjustable leg assembly attached to the frame using a piano hinge that rotates the second height adjustable leg assembly 90° inward from an extended position, wherein the second height adjustable leg assembly extends further down from the frame by attaching to an extension so the second height adjustable leg assembly rotates to fit flush against the first height adjustable leg assembly when rotated inward 90°.

11. The toilet adapter of claim 10, wherein the first height adjustable leg assembly and the second height adjustable leg assembly comprises a top metal bar having two ends and a telescoping leg welded to each of the two ends.

12. The toilet adapter of claim 11, wherein each telescoping leg welded to each of the two ends further comprises:

an upper leg welded to the top metal bar and a lower leg telescoping down from the upper leg; and the lower leg further comprises a locking pin to lock the upper leg and lower leg in position.

13. The toilet adapter of claim 10, further comprising:

at least one locking toggle disposed between the frame and the first height adjustable leg assembly to lock the first leg assembly in place when in the extended position.

14. The toilet adapter of claim 10, further comprising:

at least one locking toggle disposed between the frame and the second height adjustable leg assembly to lock the second leg assembly in place when in the extended position.

15. The toilet adapter of claim 10, wherein the extension comprises a third side member welded below the second side member.

16. The toilet adapter of claim 10, wherein the extension comprises the second side member about twice as wide vertically compared to the first side member.

17. The toilet adapter of claim 10, wherein the toilet assembly comprises a toilet seat and a toilet cover attached to the frame so as to both independently rotate between a down and up position.

18. A method for constructing a toilet adapter, comprising the steps of:

welding a metal frame together, with a front side and a back side welded at a 90° angle to a first side and a second side so as to form a one-piece rectangular frame;

attaching a first height adjustable leg assembly to the frame using a piano hinge so that the first height adjustable leg assembly rotates 90° inward from an extended position to fit flush against the frame;

attaching a second height adjustable leg assembly to the frame using a piano hinge so that the second height adjustable leg assembly rotates 90° inward from an extended position, wherein the second height adjustable leg assembly extends further down by way of an extension so the second height adjustable leg assembly rotates to fit flush against the first height adjustable leg assembly when rotated inward 90° over the retracted first height adjustable leg assembly;

attaching a right hand grip to the frame using a piano hinge;

attaching a left hand grip to the frame using a piano hinge; and attaching a toilet seat assembly to the metal frame.

19. The method for constructing a toilet adapter of claim 17, further comprising the steps of:

disposing at least one locking toggle between the frame and the first height adjustable leg assembly to lock in an extended position; and disposing at least one locking toggle between the frame and the second height adjustable leg assembly to lock in an extended position.

20. The method for constructing a toilet adapter of claim 18, wherein the extension comprises one of:

a third side member welded below the second side member; or a second side member approximately twice as wide vertically compared to the first side member.

* * * * *